United States Patent [19]

Ingle

[11] Patent Number: 4,709,650

[45] Date of Patent: Dec. 1, 1987

[54] RESCUE LAUNCHER

[76] Inventor: John W. Ingle, 85 Cynthia Road, Toronto, Ontario, Canada, M6N 2P8

[21] Appl. No.: 732,141

[22] Filed: May 9, 1985

[30] Foreign Application Priority Data

May 11, 1984 [CA] Canada ..... 454191

[51] Int. Cl.[4] ..... B63B 23/28

[52] U.S. Cl. ..... 114/375

[58] Field of Search ..... 114/365, 366, 368–375

[56] References Cited

U.S. PATENT DOCUMENTS

| | | | |
|---|---|---|---|
| 972,809 | 10/1910 | Brun | 114/375 |
| 1,270,903 | 7/1918 | Weismantel | 114/375 |
| 1,840,804 | 1/1932 | Barnett | 114/375 |
| 2,347,412 | 4/1944 | Higgins | 114/375 |
| 2,350,344 | 6/1944 | Fraser et al. | 114/375 |
| 2,896,564 | 7/1959 | Wright | 114/375 |
| 3,778,855 | 12/1973 | Kariagin et al. | 114/375 |

FOREIGN PATENT DOCUMENTS

| | | | |
|---|---|---|---|
| 888015 | 12/1971 | Canada | 114/375 |

*Primary Examiner*—Sherman D. Basinger
*Assistant Examiner*—Stephen P. Avila
*Attorney, Agent, or Firm*—George A. Rolston

[57] ABSTRACT

A launching device for rescue craft having a base portion, a ramp tilted at angle to procure initial movement of the rescue craft and, a chute with inboard and outboard ends, pivotally mounted on the base the chute being swingable between a more or less upright storage position, and a launching position, in which it swung outwardly and downwardly at a predetermined chute angle, the chute receiving the rescue craft as it moves off the ramp and supporting it for motion at a downward angle away from such base.

3 Claims, 3 Drawing Figures

36
30
38
28
38
40
40
44
44
32
34
26
42
58
26
S
52a
56
54a
52a
52
56
54
52
56
62
62
64
66

RESCUE LAUNCHER

The invention relates to a rescue launching system, and in particular to a system for launching marine rescue craft in bad weather.

BACKGROUND OF THE INVENTION

Marine rescue craft, such as lifeboats, are usually launched in rough seas. Launching may take place either from a larger marine vessel, or a drilling platform, or other structure. In the great majority of cases launching devices for such rescue craft have been in the form of rope or cable hoists, and swingable crane-like arms. The hazards involved in launching rescue craft by means of such hoisting systems are too well-known to require description. It is, however, self-evident that launching of such rescue craft is likely to be required in periods of the very worst weather conditions. The difficulties in launching such craft increase in proportion to the severity of the weather, and in particular to the wave action.

One of the principal factors contributing to the hazardous nature of the launching operation is that the rescue craft will be located closely alongside the vessel or platform from which it is being launched until such time as it is released. Once it is released it must then attempt to get underway and head away from the parent vessel.

The difficulty involved in these operations is of course greatly increased where the parent vessel is listing, and launching is taking place from the "high" side of the vessel.

Clearly, it is desirable to provide a launching system for a rescue craft by means of which the rescue craft is carried away from the vessel during launching, and is in fact projected in such a manner that it carries a certain amount of weigh whereby once it reaches the water, it will move immediately and directly away from the parent vessel and also from the launching system itself.

In addition, it is desirable to provide a launching system which is self-regulating, and which can be operated from a listing vessel with substantially equal effect, either from the high or the low side.

BRIEF SUMMARY OF THE INVENTION

With a view therefore to achieving these advantages, the invention comprises a launching device for rescue craft having a base portion, on which such rescue craft may stand, a ramp portion on said base, tilted at a predetermined angle, and adapted to procure initial movement of said rescue craft off said base, and a chute portion, having inboard and outboard ends, said inboard end being pivotally mounted to said base portion in registration with said ramp portion, and said chute portion being swingable between a more or less upright storage position, with said outboard end directed upwardly, and a launching position, wherein said chute portion is swung outwardly and downwardly at a predetermined chute angle, with said outboard end directed outwardly from said base portion, said chute portion being adapted to receive said rescue craft as the same moves off said ramp portion, and to support said rescue craft for motion at a downward angle away from such base.

More particularly, the invention provides, such a launching device, including a second said chute portion movably connected to said first chute portion, and being extendable therefrom, for providing a chute of greater length.

More particularly, it is an objective of the invention to provide such a launching device wherein the base portion and the ramp portion are so dimensioned that the rescue craft is located with a major portion of its mass on said ramp portion when in the storage position, and is restrained from such movement by said slide portion in its upright position.

The invention is particularly suited to use in association with a rescue craft which is totally closed. One form of such rescue craft will be in the shape of a sphere, having a porthole for entry and exit by passengers, and having movable seating accommodation within the hollow interior. In this type of rescue craft, the outer shell of the craft rotates, while the seating accommodation remains more or less upright, being free to move within the shell, so that the passengers may remain seated.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 1 is a side elevational view of a launching device according to the invention, shown in its stored position, with the rescue craft ready for use;

FIG. 2 is a front elevational view of the launching device of FIG. 1, shown in its launching position, with the rescue craft shown in phantom, and, FIG. 3 is a side elevational view corresponding to FIG. 1, showing the rescue launcher in its launching position, similar to that shown in FIG. 2, and showing various positions of the rescue craft in phantom, and the final position of the rescue craft in the water, in solid lines.

DESCRIPTION OF A SPECIFIC EMBODIMENT

As described above, the launching device according to the invention is particularly suitable for use with a spherical rescue craft, and accordingly this description will refer to such a launching craft without giving any details of its construction.

It is however possible within the scope of the invention that with relatively minor modifications the launching device could also be used with rescue craft of other shapes. Such rescue craft would, for reasons which will become apparent below, require to be fully decked in or otherwise totally enclosed, especially when launching in heavy waves.

Figure 1:
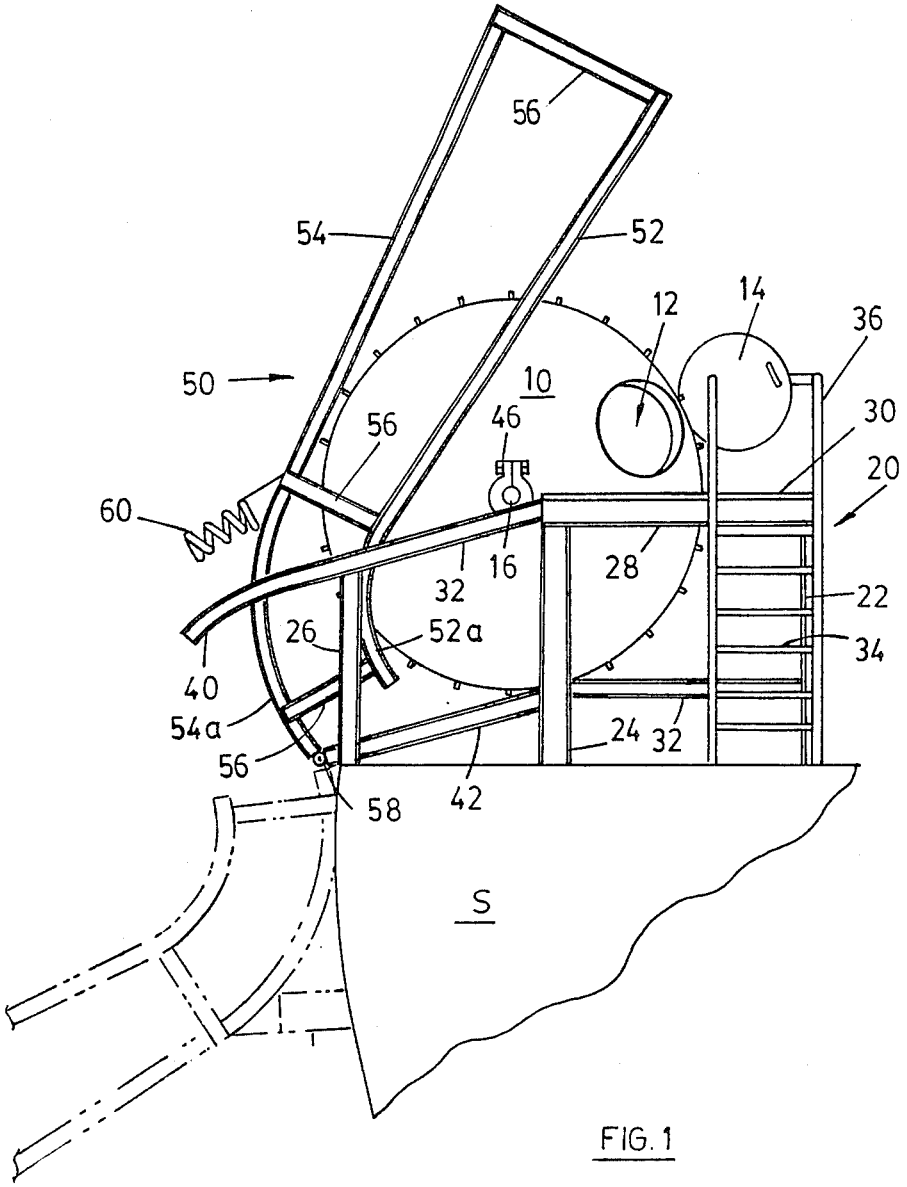

As shown in FIG. 1, the rescue craft is shown generally as 10, having a spherical shape, and having an access port or hatchway 12, by means of which persons may enter the interior, closed by a hatch cover 14.

Launching axles 16 are located on opposite sides of craft 10 for reasons to be described below.

The remaining details of the rescue craft 10 are omitted for the purposes of this discussion since they are not directly pertinent to the invention of a rescue launcher. It will however be appreciated that such a launching craft will incorporate interior seating, and bearings, and some form of motive power, and a number of transparent panels or windows by means of which the occupants can see out. It will also incorporate a supply of oxygen, food, water and the like, and other amenities necessary to sustain the occupants until they are rescued. Typically a radio, and other rescue devices such as marking systems, flares and the like will also be incorporated. None of these details are shown however, since they are not pertinent to the invention.

The rescue craft 10 is shown supported on a launching stand indicated generally as 20. The stand 20 will be seen to comprise a plurality of upright posts or pillars namely, rear posts 22, intermediate posts 24 and front posts 26. A three sided upper framework 28 connects posts 22 together and connects posts 22 with adjacent posts 24. A platform or walkway 30 extends between the rearward portions of horizontal posts 28. A plurality of lower bracing members 32 extend between posts 22 and between post 22 and adjacent post 24 to provide additional rigidity. A stairway 34 gives access to the platform 30, and is provided with suitable hand rails 36.

Extending forwardly from the upper horizontal bars 28, a pair of downwardly angled ramp rails 38, which extend over beyond the upper ends of forward posts 26, and have cantilever ends which are generally downwardly curved as at 40.

The stand 20 is shown mounted on a support structure S. The structure S may be the side of a ship, or the side of a drilling platform or any other marine structure where it may be required to launch a rescue craft in bad weather.

The lower angled bars 42 are tied at their rearward ends to a cross bracer 32, and at their forward ends, are tied by means of cross braces 44. They are located spaced apart from one another a predetermined distance, and lie parallel together, adjacent a midpoint of the stand.

The launching axles 16 of the rescue craft 10 support the rescue craft on either side, by overlying the ramp bars 38. In order to secure the rescue craft in position against inadvertant release, a pair of axle clamps 46 are provided on either side (shown only in FIG. 1) and clamps 46 are so designed that they may be of any suitable quick release variety. Bearing in mind that they must be capable of use in an emergency, after considerable time, and exposure to the elements, it may be desirable to have them fastened by some form of explosively releasable means, such as explosive bolts or the like. However, the details of such quick release fastening means are well known to persons skilled in the art and are omitted for the sake of clarity.

In order to launch the rescue craft away from the support structure or ship S, an extendable launching chute indicated generally as 50 is provided. The chute 50 will be seen to comprise in this embodiment, a pair of left and right hand slide rails 52—52, and one or more central bracing rails 54. The rails 52 and 54 are held together in the form of an open framework chute by means of two or more generally U-shaped connector bars 56. It will be appreciated that for the sake of this illustration only one bracing rail 54 and only three U-shaped connector rails 56 are shown. However, depending upon the size of the chute and the rescue craft, the chute structure may be engineered with more such rails if desired. Side rails 52 are curved upwardly at **52*a*** for reasons to be described.

Figure 2:
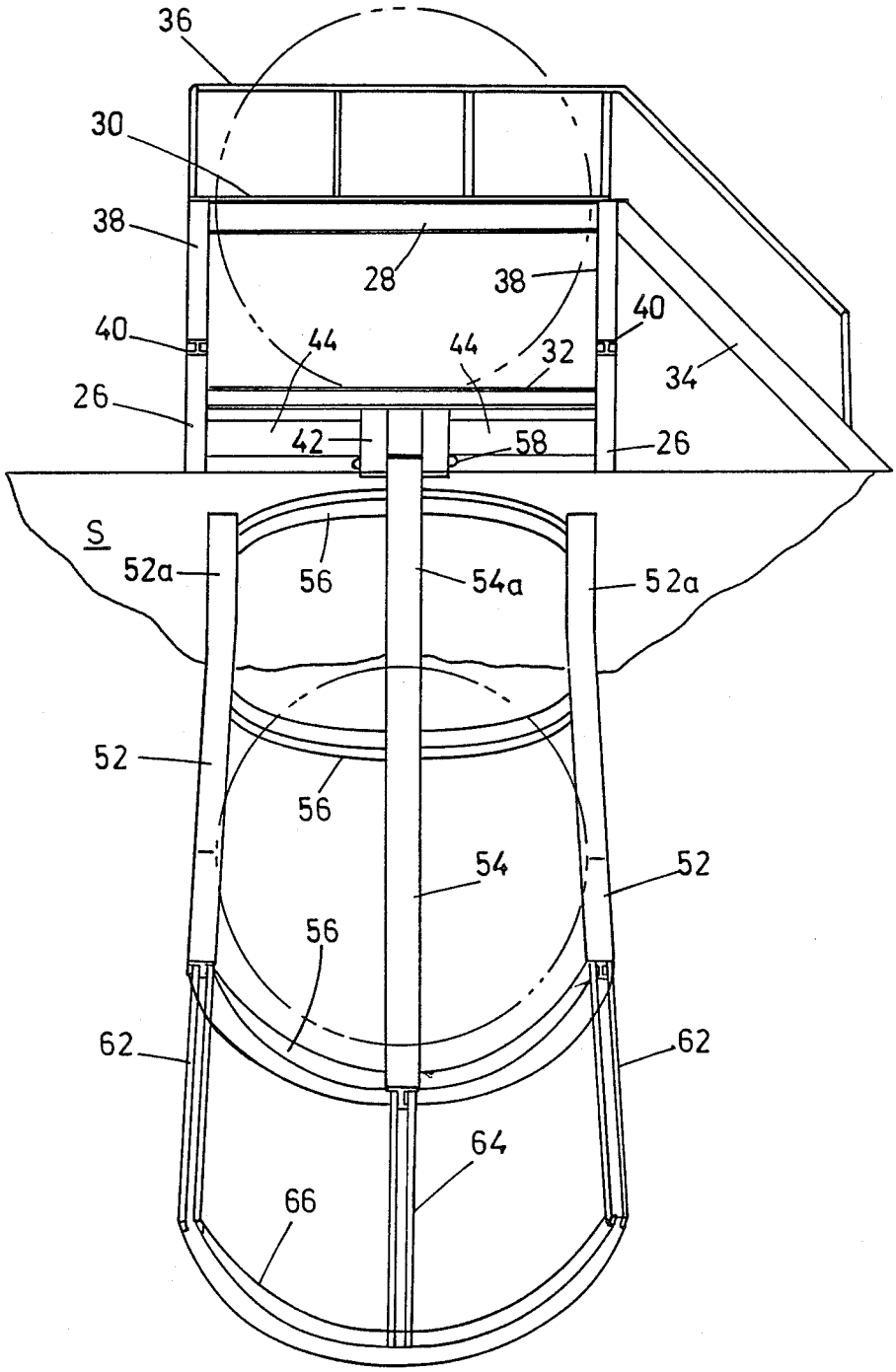
Figure 3:
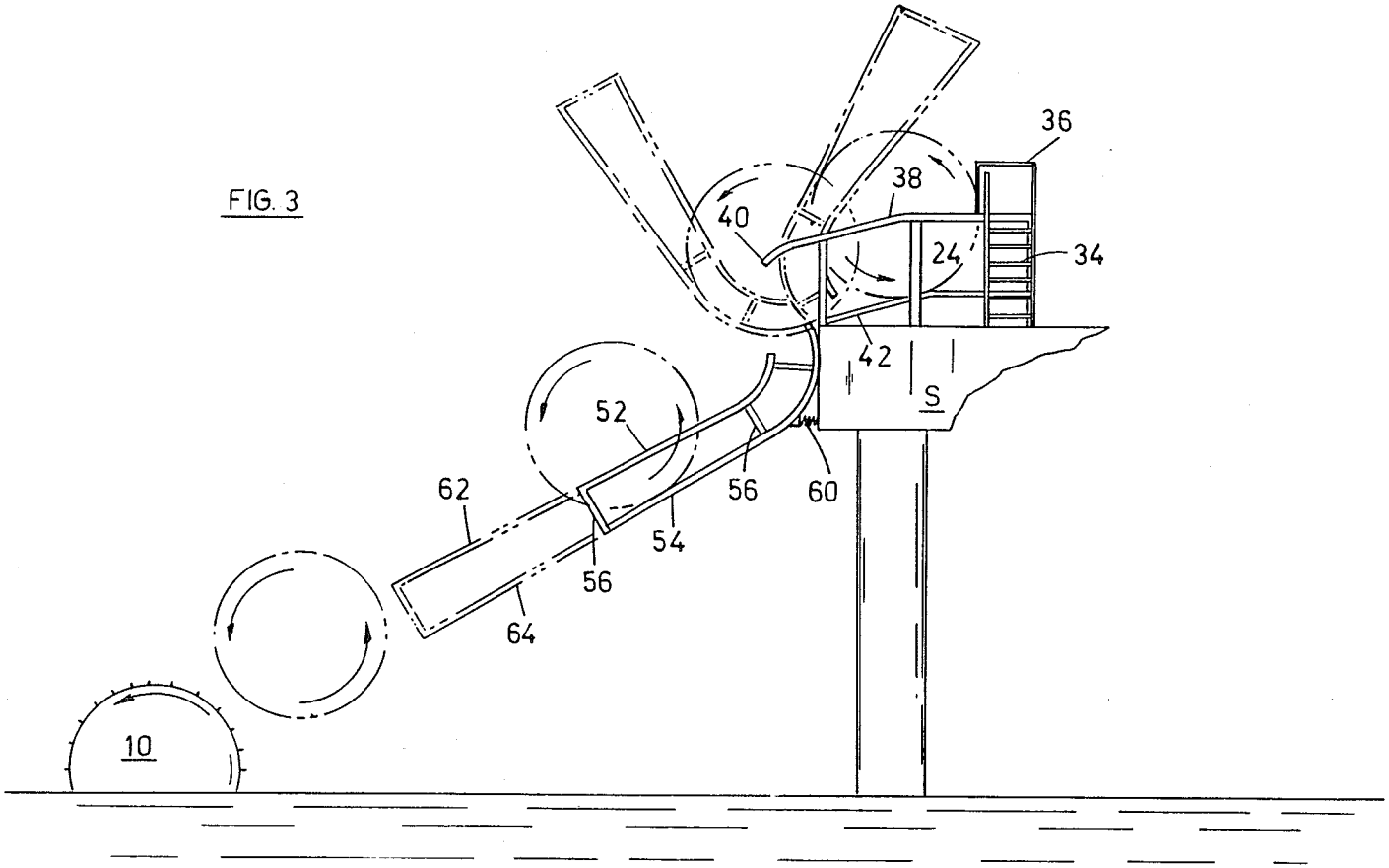

A curved portion **54*a* of the central bracing rail 54 is extended rearwardly of the rearward connector 56, and is received between the forward ends of the two lower angled bars 42 of the stand. A pivot pin 58 extends between them, so as to make a swingable connection. In this way the entire chute structure can be swung between a generally upright storage position as shown in FIG. 1, and a downwardly, outwardly angled launching position as shown in FIGS. 2 and 3**.

Any suitable storage locking mechanism (not shown) may be provided whereby the chute may be secured in its storage position. Such locking mechanism will be of the quick release variety and may incorporate explosive bolts or the like, to insure speedy release even after years of inactivity and exposure to the elements.

If desired some form of restraining or control means may be provided whereby to control the outward or downward swinging of the chute. Such a control mechanism could comprise some form of cylinder mechanism or alternatively, could comprise wires or cables stored on suitable drums. However, the details of such restraint mechanism are not shown, since they might vary widely from one design to another, and are in any event well known to persons skilled in the art.

In the present embodiment of the invention therefore it is sufficient that such restraint mechanism is shown in the form of a spring 60 mounted on the underside of the central rail 54. The spring 60 is arranged so that it will contact the side of the structure S and cushion the fall of the chute.

In accordance with a particularly advantageous feature of the invention, the chute may be of telescopic construction. An extendable chute assembly comprising side rails 62, and a central rail 64, and one or more further U-shaped connectors 66, is extendably connected to the corresponding bars 52 and 54 of the main portion of the chute. As the chute swings outwardly and downwardly, such extendable telescopic portion will be released automatically under its own weight.

In accordance with a particularly advantageous feature of the invention, the speed of descent of the rescue craft can be to some extent controlled in the following manner. The ramp bars 38 are located a predetermined distance apart sufficient to and accomodate the entire diameter of the rescue craft. The rescue craft in fact rests on the ramp bars 38, on its launching axles 16.

However, the side rails 52 and 52, and 62 and 62 of the chute 50 are located closer together than the ramp bars 38. Thus, when the rescue craft initially starts its descent, the launching axle 16 will ride on the ramp bars 38. This will produce a fairly rapid acceleration for the rotational speed of the rescue craft. As it moves from the ramp bars 38 to the side rails 52 and and 52, it will then be riding on the exterior surface of its shell, and not on the launching axle 16. This will somewhat reduce the rate of rotation.

It will thus be seen that when the rescue craft 10 reaches the end of the extended chute, it will be close to the surface of the water. It will then drop the short remaining distance into the water, while still rotating, in a direction directly away from the support structure S.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A launching device for a rotatable rescue craft having a spherical exterior and comprising;

a base portion, for supporting said rescue craft;

a ramp portion on said base portion, ramp rail means on said ramp portion spaced apart a predetermined distance to engage said rescue craft, and located at a predetermined height and defining a predetermined spacing therebeneath to receive and support said rescue craft therebetween, said ramp rail means being tilted at a predetermined launching angle, and adapted to procure initial movement of said rescue craft off said base portion, said base portion and said ramp portion being so dimensioned so that said rescue craft is located with a major portion of its mass on said ramp portion when in said storage position and releaseable means restraining it from such movement;

a chute portion, having inboard and outboard ends, said inboard end being pivotally mounted to said base portion in registration with said ramp portion, and said chute portion being swingable between a more or less upright storage position, with said outboard end directed upwardly, and a launching position, wherein said chute portion is swung outwardly and downwardly at a predetermined launching angle, with said outboard end directed outwardly from said ramp portion;

chute rail means on said chute portion spaced apart a lesser distance than said ramp rail means and being adapted to receive said rescue craft as the same moves off said ramp rail means, and to support said rescue craft for motion at a downward angle away from said base portion, and, a second said chute portion movably connected to said first chute portion, and being extendable therefrom.

2. A launching device as claimed in claim 1 including retaining means retaining said chute portion in its storage position, and being releaseable to move into its launching position.

3. A launching device as claimed in claim 1 wherein said second chute portion telescopes relative to said first chute portion.

* * * * *